United States Patent [19]

Audeh

[11] Patent Number: 4,500,414

[45] Date of Patent: Feb. 19, 1985

[54] ENHANCED RECOVERY OF HYDROCARBONACEOUS FLUIDS FROM THE OIL SHALE

[75] Inventor: Costandi A. Audeh, Princeton, N.J.

[73] Assignee: Mobil Oil Corporation, New York, N.Y.

[21] Appl. No.: 609,074

[22] Filed: May 10, 1984

Related U.S. Application Data

[63] Continuation of Ser. No. 488,517, Apr. 25, 1983.

[51] Int. Cl.[3] ..... C10G 1/00

[52] U.S. Cl. ..... 208/11 R; 208/11 LE

[58] Field of Search ..... 208/11 R, 11 LE

[56] References Cited

U.S. PATENT DOCUMENTS

| | | | |
|---|---|---|---|
| 4,005,005 | 1/1977 | McCollum et al. | 208/11 LE |
| 4,197,183 | 4/1980 | Audeh | 208/11 LE |
| 4,409,091 | 10/1983 | Kessick | 208/11 LE |
| 4,414,117 | 11/1983 | Yong et al. | 208/11 LE |
| 4,419,217 | 12/1983 | Audeh | 208/11 LE |

*Primary Examiner*—Delbert E. Gantz
*Assistant Examiner*—Anthony McFarlane
*Attorney, Agent, or Firm*—Alexander J. McKillop; Michael G. Gilman; Charles J. Speciale

[57] ABSTRACT

The present invention relates to a process for recovery of additional hydrocarbonaceous fluids from spent oil shale that had been subjected to regular retorting operations, by treating the spent shale with an alkali-methoxide/methanol solution.

10 Claims, No Drawings

ENHANCED RECOVERY OF HYDROCARBONACEOUS FLUIDS FROM THE OIL SHALE

This application is a continuation of U.S. application having Ser. No. 488,517 filed Apr. 25, 1983.

FIELD OF THE INVENTION

The present invention relates to an improved process for the recovery of hydrocarbonaceous fluids from oil shale. Particularly, the present invention relates to an improvement in the yield of hydrocarbonaceous fluids in oil shale retorting.

BACKGROUND OF THE INVENTION

The potential reserves of liquid hydrocarbons contained in subterranean carbonaceous deposits are known to be very substantial and form a large portion of the known energy reserves in the world. In fact, the potential reserves of liquid hydrocarbons to be derived from oil shale greatly exceed the known reserves of liquid hydrocarbons to be derived from petroleum. As a result of the increasing demand for light hydrocarbon fractions, there is much current interest in economical methods for recovering liquid hydrocarbons from oil shale on commercial scales.

It has long been known that oil may be extracted by heat from various extensive deposits of porous minerals known by their generic term oil shale, which are permeated by a complex organic material called "kerogen". Upon application of heat, the kerogen is converted to a complex mixture of hydrocarbons and hydrocarbon derivatives which may be recovered from a retort as a liquid shale oil product.

Eastern shales are known to contain an equal proportion of organic carbon as the western shales. However, upon retorting only 30% of this carbon is converted to oil. This conversion is less than half of the conversion achieved by retorting western shale. To clarify this fact, consider two shale oil samples containing 13.6% organic carbon. Retorting the western shale would reduce this carbon to about 4%. On the other hand, retorting eastern shale would reduce this carbon to only about 10%. Thus, any technique that may be used to improve this conversion as measured by enhancement in oil yield will be highly advantageous particularly when applied to eastern shale.

Accordingly, the present invention provides a process to enhance the yield of hydrocarbon fluids in the retorting of oil shale.

SUMMARY OF THE INVENTION

Oil shale is retorted in the usual manner, for example by heating to 500° C. In this step all the shale oil is recovered by the standard retorting procedure. Upon complete recovery of the shale oil from the oil shale in the usual retorting procedure, a solution of an alkali-methoxide in methanol is introduced into the hot retort containing the spent shale. This treatment produces an additional amount of oil, dimethyl ether, hydrogen sulfide, light hydrocarbons, hydrogen, carbon monoxide and/or carbon dioxide. Unreacted methanol is also recovered.

DESCRIPTION OF THE SPECIFIC EMBODIMENTS

Retorting is applied to thermally decompose oil shale which yields liquid gaseous and solid products. In a simpler form of retorting, the oil shale is optionally crushed to desirable size and placed in a retort vessel to simply keep the shale in place. An outside source of heat, for example a furnace, is utilized to heat up the retort vessel walls. The retort vessel walls transmit the heat to the contents of the retort wherein decomposition of the kerogen takes place. The liquid which is produced by pyrolysis, is in the form of a vapor or mist as are the non-condensable hydrocarbon gases. The remaining organic carbon remains on the retorted shale as a coke-like deposit. Several processes for retorting oil shale are described in Kirk-Othmer, encyclopedia of Chemical Technology, Third Edition, Vol. 20, pp. 333–341, which are hereby incorporated by reference in their entirety.

Whichever retorting method is utilized, the liquid and gas products are recovered and the solid products, or spent shale, are normally disposed of. In accordance with the present invention, a method is utilized to enhance the yield of liquid products from the spent shale, Thus, after retorting the oil shale in the usual manner, a solution of an alkali-methoxide in methanol is introduced into the hot retort containing the spent shale, for example by the upflow pumping of the treating solution through the spent shale. This treatment produces an additional amount of oil, dimethyl ether, hydrogen sulfide, light hydrocarbons, hydrogen, carbon monoxide and carbon dioxide. Unreacted methanol is also recovered.

There are several types of methoxides which can be incorporated into the process of the present invention. The most useful are the methoxides associated with the elements listed in Group 1 of the Periodic Table of the Elements, or the alkali-methoxides. Representative examples of alkali-methoxides which may be used interchangeably in the present invention include, but are not limited to, sodium methoxide, lithium methoxide and potassium methoxide. References which disclose these alkali methoxides behaving in the same fashion chemically include: Reinheimer, John D., et al., "The Salt Effect in the Aromatic Nucleophilic Substitution Reaction," *J. Am. Chem. Soc.*, 79, 1263 (1957); and Hunig, S., et al., "Acid Cleavage of 2-acyl-2-methylcyclohexanone by Bases," *Angew. Chem.*, 72, 323 (1960).

In addition to increasing the hydrocarbon yield of the shale oil, the treatment results in the formation of dimethyl ether from the solution of alkali-methoxide in methanol. When the treating mixture, alkali-methoxide/methanol, is heated to the retorting temperature under the same process conditions and in the same reactor but in the absence of shale, the mixture is recovered essentially unchanged. It appears that the shale has chemical or possible catalytic activity such that methanol is converted to dimethyl ether in the presence of a strong base.

The products formed in the treatment of spent shale with the alkali-methoxide in methanol solution are separated by condensation. At room temperature the methanol/oil mixture is recovered and at reduced temperatures the lower boiling hydrocarbons and dimethyl ether are condensed. When present, hydrogen sulfide and carbon dioxide are easily removed by well-known processes, such as the amine process. Light hydrocarbons, hydrogen and carbon monoxide could either be used as a fuel or separated into components as needed. Unreacted methanol is purified by a distillation step and mixed with an alkali-methoxide and reused in the process.

Accordingly, the treatment of spent shale with an alkali-methoxide in methanol solution results in the enhancement of oil yield and additionally the possible catalytic/chemical involvement of the shale in the formation of dimethyl ether from the alkali-methoxide/-methanol mixture.

EXPERIMENTS

The present invention is illustrated by the following experiments, which are not meant to limit the invention. Oil shale was packed into a retort vessel having means for upflow pumping of fluids through the vessel. The shale was subjected to retorting to recover hydrocarbons therefrom. After retorting ceased to yield hydrocarbons, the spent shale was treated with a methanol solution containing 15 weight percent sodium methoxide at 495° C. and under 1500 lbs. of pressure. The sodium methoxide/methanol solution was pumped into the retort vessel at a rate of 24 cc/hr. for 2 hours.

As soon as the methoxide/methanol solution hit the spent shale, additional production of oil was observed. The resultant fractions were condensed to yield three fractions of fluids. One fraction represented the additional oil produced which amounted to a 20 percent increase in oil production. The second trap contained 70 volume percent of the fluids produced and analysis showed that it was mainly methanol. The third trap contained 15 volume percent of the fluids produced and analysis showed that it was mainly dimethyl ether, i.e., more than 80 percent dimethyl ether.

The treatment with the alkali-methoxide/methanol solution also resulted in the production of 40 liters of gas which was mainly hydrogen. Analysis of the gas showed that it contained about 68% hydrogen, 21% carbon monoxide with the remainder comprising carbon dioxide, methane, and traces of light hydrocarbons.

In a second experiment, the methoxide/methanol mixture was subjected to treatment under the same conditions but in the absence of spent shale, however, the product was essentially unchanged methoxide/methanol mixture.

Although the present invention has been described with preferred embodiments, it is to be understood that modifications and variations may be resorted to, as those skilled in the art will readily understand. Such modifications and variations are considered to be within the purview and scope of the appended claims.

What is claimed is:

1. A process for improving the recovery of hydrocarbon liquids and gases from oil shale comprising the steps of:

(a) subjecting the oil shale to retorting, under retorting conditions, to produce liquid and gaseous hydrocarbons and spent shale; and (b) treating the spent shale with a solution of alkali-methoxide in methanol to recover additional hydrocarbon liquids and gases.

2. The process of claim 1 wherein said alkali-methoxide is selected from the group consisting of sodium methoxide, lithium methoxide and potassium methoxide.

3. The process of claim 1 wherein said alkali-methoxide is sodium methoxide.

4. The process of claim 3 wherein said sodium methoxide in methanol solution is utilized with the concentration of sodium methoxide being from about 1% to about 50% by weight.

5. The process of claim 3 wherein said sodium methoxide in methanol solution is utilized with the concentration of sodium methoxide being from about 10% to about 20% by weight.

6. The process of claim 1 wherein the treatment of the spent shale with said solution of alkali-methoxide in methanol results in the formation of dimethyl ether.

7. The process of claim 1 wherein the spent shale is treated, with said solution of alkali-methoxide in methanol, under retorting conditions.

8. A process for improving the recovery of hydrocarbon liquids and gases from oil shale comprising the steps of:

(a) subjecting the oil shale to retorting, under retorting conditions, to produce liquid and gaseous hydrocarbons and spent shale; and (b) treating spent shale with a solution of sodium methoxide in methanol, wherein the concentration of sodium methoxide is from about 10 weight percent to about 20 weight percent, to recover additional hydrocarbon fluids and gases, hydrogen gas, and dimethyl ether.

9. The process of claim 8 wherein the spent shale is treated with said solution of sodium methoxide in methanol under retorting conditions.

10. A process for improving the recovery of hydrocarbon liquids and gases from oil shale comprising the steps of:

(a) subjecting the oil shale to retorting, under retorting conditions, to produce liquid and gaseous hydrocarbons and spent shale; and (b) treating the spent shale, under retorting conditions, with a solution of sodium methoxide in methanol, wherein the concentration of sodium methoxide is from about 10 weight percent to about 20 weight percent, at a temperature of from about 400° C to about 550° C. and under about 1,000 lbs. to 2,000 lbs. of pressure, to recover additional hydrocarbon liquids and gases, said gases, comprising hydrogen and dimethyl ether.

* * * * *